United States Patent [19]

Lerner et al.

[11] Patent Number: 4,709,429

[45] Date of Patent: Dec. 1, 1987

[54] BATHTUB SPOUT COVER

[75] Inventors: Michael Lerner, Brookline; Michael Bernstein, Natick; Robert Selame, Brookline, all of Mass.

[73] Assignee: Safety 1st, Inc., Chestnut Hill, Mass.

[21] Appl. No.: 896,656

[22] Filed: Aug. 13, 1986

[51] Int. Cl.[4] ..... A47K 17/00; A47K 13/00

[52] U.S. Cl. ..... 4/661; 4/DIG. 18

[58] Field of Search ..... 4/661, DIG. 18; 239/602; 206/522; 150/52 R

[56] References Cited

U.S. PATENT DOCUMENTS

| | | | |
|---|---|---|---|
| 1,457,496 | 6/1953 | Butler | 206/522 |
| 2,729,259 | 1/1956 | Abrams | 150/52. R |
| 3,634,970 | 1/1972 | Williams | 150/52 R |
| 3,891,082 | 6/1975 | Fall | 206/522 X |
| 4,164,970 | 8/1979 | Jordan | 206/522 X |
| 4,353,139 | 10/1982 | Wainwright et al. | 4/661 |

*Primary Examiner*—Henry K. Artis

*Attorney, Agent, or Firm*—Wolf, Greenfield & Sacks

[57] ABSTRACT

A bathtub spout cover includes a plurality of inflatable side compartments joined along their edges to form a protective sleeve and an inflatable end compartment closing one end of the protective sleeve. An opening in the protective sleeve permits discharge of water from the bathtub spout. A removable tear-out strip in the protective sleeve provides access to a shower control knob on the bathtub spout. Preferably, the cover is made by sealing together sheets of plastic material. An inflation port permits the cover to be inflated by mouth.

6 Claims, 5 Drawing Figures

BATHTUB SPOUT COVER

FIELD OF THE INVENTION

This invention relates to protective covers for bathtub spouts and, more particularly, to an inflatable bathtub spout cover which is low in cost, is easily manufactured and is effective in use. The bathtub spout cover is provided with a special tear-out strip which permits use with a shower diverter knob.

BACKGROUND OF THE INVENTION

It is well known that many household accidents resulting in personal injury occur in the bathtub. The accidents often occur as a result of slipping on wet surfaces and as a result of children playing. One of the sources of injury is a person striking his or her head or other body parts against the bathtub water spout during a fall.

Various bathtub spout covers are known in the prior art. A protective cover of soft deformable material such as foam rubber or plastic is disclosed in U.S. Pat. No. 4,353,139 issued Oct. 12, 1982 to Wainwright et al. The disclosed cover has a hollow tubular configuration with an opening for water discharge. Such bathtub spout covers are relatively expensive to manufacture since a molding process is required and are relatively expensive to ship because they cannot be disassembled or otherwise reduced in volume.

It is a general object of the present invention to provide an improved bathtub spout cover with a cushion of air.

It is another object of the present invention to provide a bathtub spout cover which protects against injury due to impact on a bathtub spout.

It is yet another object of the present invention to provide a bathtub spout cover which is low in cost and is easily manufactured.

It is a further object of the present invention to provide a bathtub spout cover which can be reduced to a smaller volume for shipment.

SUMMARY OF THE INVENTION

According to the present invention, these and other objects and advantages are achieved in a bathtub spout cover comprising a cover body for cushioning the bathtub spout including a plurality of inflatable side compartments attached along their edges to form a protective sleeve and an inflatable end compartment closing one end of the protective sleeve, the other end of the protective sleeve being open to permit the cover to be slipped over the bathtub spout. The bathtub spout cover further includes means permitting inflation and deflation of the inflatable compartments and an opening in the protective sleeve for discharge of water from the end of the bathtub spout.

In a preferred embodiment, the bathtub spout includes a removable, tear-out strip in the protective sleeve for access to a shower control knob on the bathtub spout. It is preferred that the protective sleeve comprise two plastic sheets sealed together at opposite ends with opposite side edges sealed together to form the protective sleeve and the sheets sealed together along parallel, spaced-apart lines between the ends to define the side compartments. The end compartment preferably comprises two circular plastic sheets sealed together around their edges and attached at their edges to the protective sleeve. The side and end compartments are connected so as to permit air flow from an inflation port to all compartments.

BRIEF DESCRIPTION OF THE DRAWINGS

For a better understanding of the present invention, together with other and further objects and advantages thereof, reference is made to the accompanying drawings which are incorporated herein by reference and in which.

DETAILED DESCRIPTION OF THE INVENTION

Figure 1:
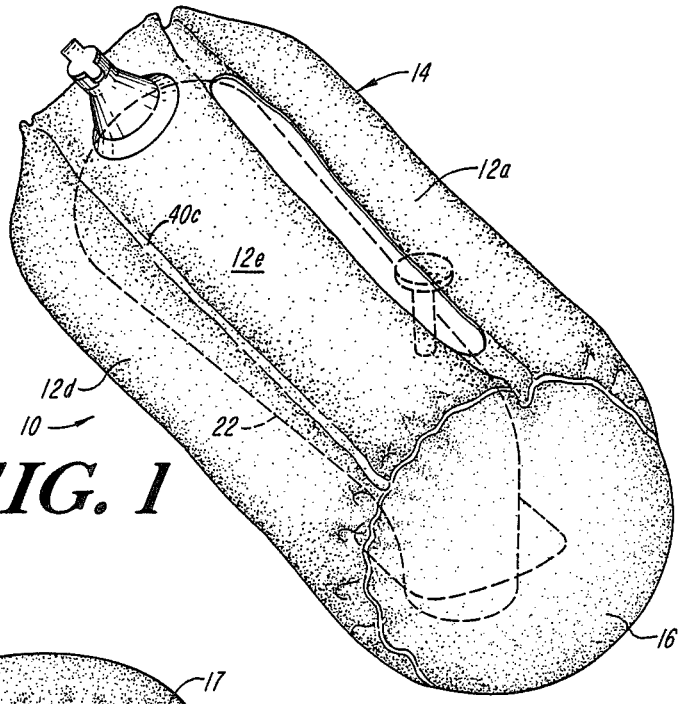
FIG. 1 is a perspective view of the bathtub cover of the present invention with a bathtub spout shown in phantom.
Figure 2:
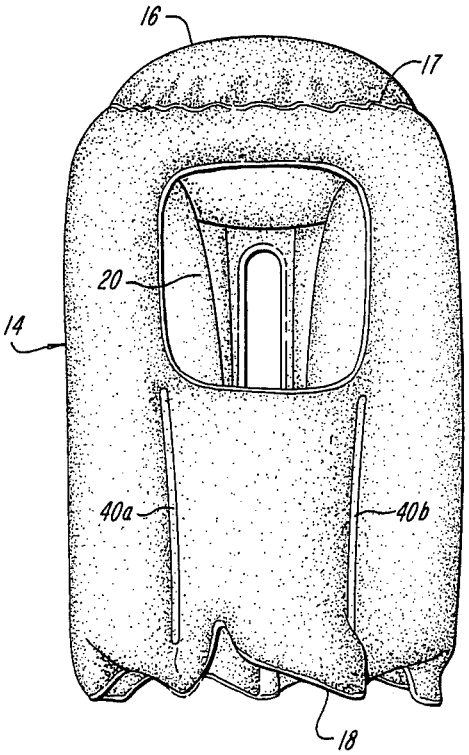
FIG. 2 is a bottom view of the bathtub spout cover of FIG. 1.
Figure 3:
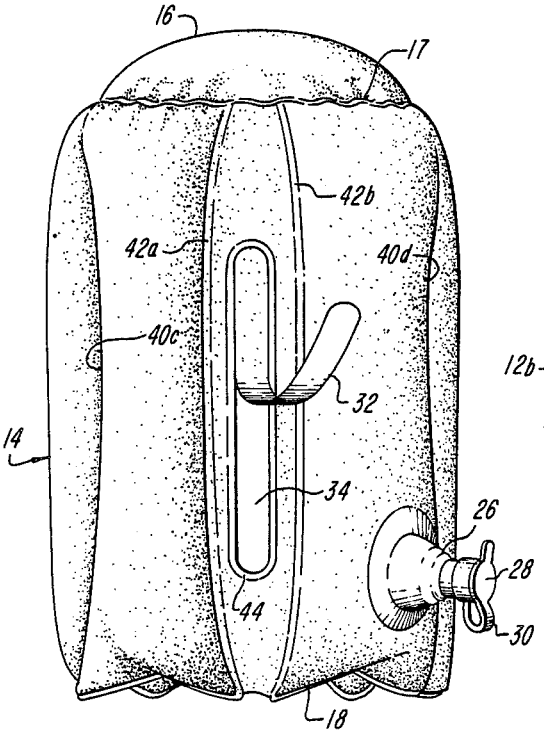
FIG. 3 is a top view of the bathtub spout cover of FIG. 1.
Figure 4:
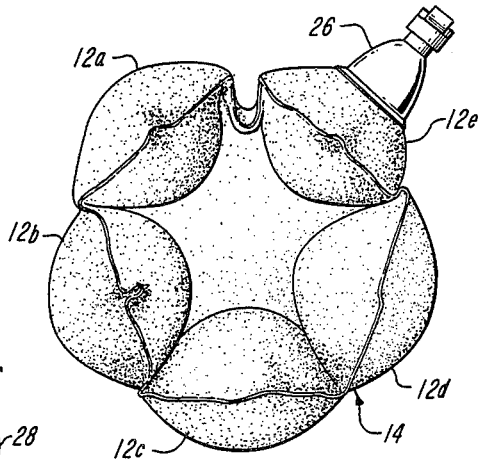
FIG. 4 is an end view of the bathtub spout cover of FIG. 1 from the open end.
Figure 5:
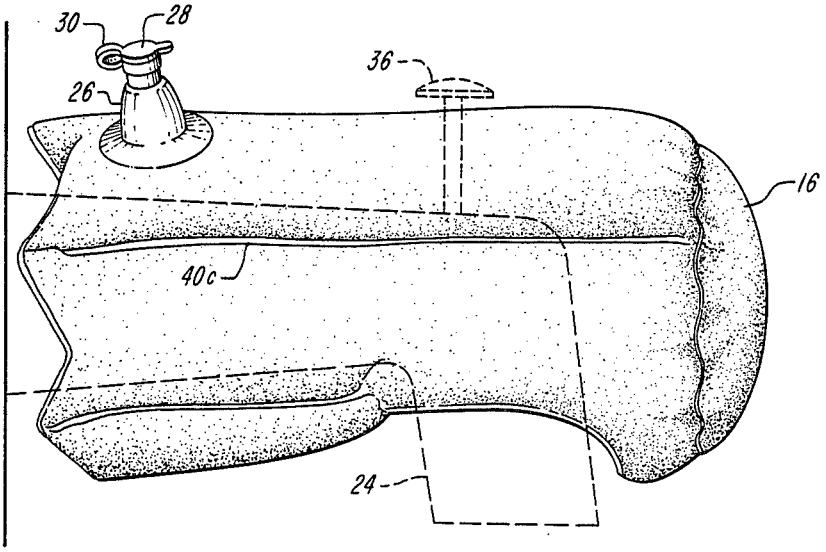
FIG. 5 is a side view of the bathtub spout cover of FIG. 1 with the bathtub spout shown in phantom.

The bathtub spout cover of the present invention is illustrated in FIGS. 1–5. The cover shown generally at 10 includes a cover body having a plurality of inflatable side compartments 12*a*, 12*b*, 12*c*, 12*d* and 12*e*, as best seen in FIG. 4, joined along their edges to form a closed protective sleeve of more or less cylindrical shape when inflated. The cover body also includes an inflatable end compartment 16 which closes one end 17 of the protective sleeve 14. The other end 18 of the protective sleeve 14 is open for mounting on the bathtub spout.

Protective sleeve 14 is provided adjacent to the end compartment 16 with a side opening 20 for discharge of water from the end of the bathtub spout 22. Depending on the design of the bathtub spout 22, a downward extension 24 of the spout 22 may pass through the opening 20 or, if the spout 22 does not have a downward extension 24, the water is discharged through the opening 20 from inside the cover protective sleeve 14.

The cover is provided with means for inflating and deflating the side compartments 12*a*, 12*b*, 12*c*, 12*d*, 12*e* and the end compartment 16. In a preferred embodiment, a raised inflation port 26, similar to those used on beach balls and the like, is provided for inflation by mouth. The port 26 is provided with a plug 28 attached thereto with a flexible strip 30. As will be described hereinafter, the side compartments 12*a*, 12*b*, 12*c*, 12*d*, 12*e* and end compartment 16 are interconnected to permit air flow between compartments so that the entire inflatable cover body can be inflated through the single inflation port 26.

The cover body is preferably provided with a removable, tear-out strip 32 which can be removed to define an opening 34 for access to a shower control knob 36. In cases where the shower control knob is not located on the bathtub spout 22, the tear-out strip 32 can be left in place. The opening 34 is elongated to permit use with bathtub spouts having shower control knobs 36 in different positions along their length.

In a preferred construction, the bathtub spout cover described above is fabricated from sheets of vinyl plastic. The side compartments 12*a*, 12*b*, 12*c*, 12*d*, 12*e* are fabricated from two plastic sheets of equal size. The sheets are sealed together around their edges. Then, the sheets are sealed along parallel sealing lines 40*a*, 40*b*, 40*c*, 40*d*, and 42*a*, 42*b* to define the side compartments 12*a*, 12*b*, 12*c*, 12*d*, 12*e*. Then, the opposite side edges of the two sheets are joined together to form the closed protective sleeve 14 as shown in FIG. 4. Preferably, the sheets are sealed together by a heat seal. It will be noted that the sealing lines 40*a*, 40*b*, 40*c*, 40*d* do not extend the entire length of the protective sleeve 14 so as to leave adjacent compartments in gas communication and to permit passage of air from compartment to compartment. However, the sealing lines 42*a*, 42*b* on opposite sides of the tear-out strip 32 extend the entire length of the cover and seal the region of the tear-out strip 32 so that it is not inflated with the rest of the cover. The tear-out strip 32 is defined by deep sealing of the two plastic sheets together around its periphery thereby permitting the strip 32 to be torn out along sealing line 44.

The end compartment 16 is formed of two circular plastic sheets sealed together around their edges and attached to the end 17 of the protective sleeve 14. The end compartment 16 is connected for air flow to one of the side compartments by bonding together a small area of the end compartment 16 and one of the side compartments and then punching a small hole between the two compartments in the sealed together region.

The air in the side compartment and the end compartments provides cushioning against sudden impact. The compartments with relatively small interconnecting passages for air insures that upon sudden impact the air is not all displaced to another portion of the cover which would frustrate the purpose of the cover.

In use the bathtub spout 10 of the present invention is simply inflated and is slipped over the bathtub spout so that water can be discharged through the opening 20. The strip 32 is removed if necessary for access to a shower control knob 36. When not in use or during shipment, the bathtub cover 10 can be deflated and folded to a small volume. The bathtub spout cover of the present invention can be constructed with a variety of colors and materials. For example, the two plastic sheets which comprise the cover can be of different color, one or more of the sheets can be transparent if so desired and designs can be printed thereon for an attractive appearance.

While there has been shown and described what is at present considered the preferred embodiment of the present invention, it will be obvious to those skilled in the art that various changes and modifications may be made therein without departing from the scope of the invention as defined by the appended claims.

What is claimed is:

1. A bathtub spout cover comprising:

a cover body for cushioning the bathtub spout including a plurality of inflatable side compartments attached along their edges to form a protective sleeve and an inflatable end compartment closing one end of said protective sleeve, the other end of said protective sleeve being open to permit the cover to be slipped over said bathtub spout, said side compartments having relatively small interconnecting air passages to enhance the impact cushioning ability of said bathtub spout cover;

means permitting inflation and deflation of said inflatable compartments; and an opening in said protective sleeve for discharge of water from the end of said bathtub spout.

2. A bathtub spout cover as defined in claim 1 wherein said inflation and deflation means comprises an inflation port in one of said compartments and a removable plug for said inflation port and wherein said side and end compartments are interconnected to permit air flow therebetween.

3. A bathtub spout cover as defined in claim 1 further including a removable strip in said protective sleeve for access to a shower control knob on said bathtub spout.

4. A bathtub spout cover as defined in claim 3 wherein said protective sleeve comprises two sheets sealed together around their edges and sealed together along parallel, spaced-apart lines between opposite ends to define said side compartments, the opposite side edges of said sheets being joined together to form said protective sleeve.

5. A bathtub spout cover as defined in claim 4 wherein said removable strip is formed by sealing said sheets together at the edges of said strip thereby permitting said strip to be torn out.

6. A bathtub spout cover as defined in claim 4 wherein said end compartment comprises two circular sheets sealed together around their edges and attached at their edges to said protective sleeve.

* * * * *